US006467236B1

(12) United States Patent
Schlegel

(10) Patent No.: US 6,467,236 B1
(45) Date of Patent: Oct. 22, 2002

(54) APPARATUS TO ASSIST IN INSTALLATION OF DRYWALL

(76) Inventor: Gary R. Schlegel, 1449 Plymouth Ave., Irwin, PA (US) 15642

( * ) Notice: Subject to any disclaimer, the term of this patent is extended or adjusted under 35 U.S.C. 154(b) by 0 days.

(21) Appl. No.: 09/631,425

(22) Filed: Aug. 3, 2000

(51) Int. Cl.[7] ..... F04D 15/04

(52) U.S. Cl. ..... 52/749.1; 52/DIG. 1; 52/127.7; 52/127.8; 52/127.2; 52/127.5; 248/317

(58) Field of Search ..... 52/506.05, 749.1, 52/DIG. 1, 127.1, 122.1, 127.2, 127.5, 127.6, 127.7, 127.8, 126.5, 514, 714, 749.11; 248/342, 343, 201, 317

(56) References Cited

U.S. PATENT DOCUMENTS

| | | | | | |
|---|---|---|---|---|---|
| 787,839 | A | * | 4/1905 | Ernst | 52/127.2 |
| 1,230,093 | A | * | 6/1917 | Adey | 52/127.1 |
| 1,843,454 | A | * | 2/1932 | Manson | 248/317 |
| 2,481,437 | A | * | 9/1949 | Miller | 52/127.7 |
| 2,608,369 | A | * | 8/1952 | Hocher | 248/317 |
| 3,333,322 | A | * | 8/1967 | Toffolon | 52/127.8 |
| 4,045,926 | A | * | 9/1977 | Gibbs | 52/127.1 |
| 4,413,453 | A | * | 11/1983 | Witte | 52/127.1 |
| 4,449,338 | A | * | 5/1984 | Reicherts | 52/127.8 |
| 4,571,902 | A | * | 2/1986 | Liebetrau | 52/127.2 |
| 4,591,308 | A | * | 5/1986 | Imai | 414/11 |
| 4,709,460 | A | * | 12/1987 | Luhowyj | 29/271 |
| 4,995,605 | A | * | 2/1991 | Conville | 52/770 |
| 5,371,994 | A | * | 12/1994 | Waters | 52/749 |
| 5,732,527 | A | * | 3/1998 | Schneider | 52/749.1 |
| 5,884,447 | A | * | 3/1999 | Earp | 52/489.1 |
| 5,921,058 | A | * | 7/1999 | Brooker | 52/749.1 |
| 6,029,407 | A | * | 2/2000 | Schillero, Jr. | 52/127.2 |
| 6,293,058 | B1 | * | 9/2001 | Sink | 52/127.1 |

* cited by examiner

*Primary Examiner*—Beth A. Stephan
*Assistant Examiner*—Phi Dieu Tran A
(74) *Attorney, Agent, or Firm*—James Ray Associates

(57) ABSTRACT

The present invention provides an apparatus for supporting and holding a building panel during installation onto an overhead building structure. The apparatus comprises a bar member for supporting at least a portion of such building panel. The bar member has an elongated portion to be disposed substantially parallel to such overhead building structure when secured to at least one of such overhead building structure and a building wall in a working position, the elongated portion has each of a predetermined length and a predetermined shape. There is an arcuately shaped portion connected to the elongated portion of the bar member adjacent a first end thereof and at least one means disposed adjacent a second end of the elongated portion of the bar member for anchoring the apparatus to such overhead building structure and such building wall. There is also a means engageable with such at least one means for anchoring the apparatus to such overhead building structure and such building wall for enabling attachment of the apparatus to such overhead building structure and such building wall.

27 Claims, 4 Drawing Sheets

APPARATUS TO ASSIST IN INSTALLATION OF DRYWALL

FIELD OF THE INVENTION

The present invention relates, in general, to the installation of drywall and plasterboard and, more particularly, the present invention relates to an apparatus for assisting a single worker in the installation of overhead drywall and plasterboard.

BACKGROUND OF THE INVENTION

The installation of overhead ceiling panels of drywall and plasterboard has always been a difficult job because of the size of the panels. The operation in the past has required two or more persons to perform this task. One worker is needed to hold the panel while the other worker attaches or secures the panel to the roof trusses or ceiling joists with screws or nails. This has been necessary because it is extremely difficult for one person to hold a ceiling panel and still be able to attach the panel to ceiling joists with either screws or nails.

Even with two people the task is still an arduous one because the panels are generally 4 foot by 8 foot and although the panels may not be excessively heavy the panels are not light and are extremely awkward to handle. Further, holding ceiling panels above one's head for a period of time is a very tiring operation.

Thus, there has been and still is a need for some type of equipment that could assist a single worker in the installation of these ceiling panels. With such equipment it would be possible for a worker to install the panel alone without being required to have a second worker assist in the operation.

SUMMARY OF THE INVENTION

A first embodiment of the present invention provides an apparatus for supporting and holding a building panel during installation onto an overhead building structure. The apparatus comprises a bar member for supporting at least a portion of such building panel. The bar member has an elongated portion to be disposed substantially parallel to such overhead building structure when secured to at least one of such overhead building structure and a building wall in a working position, the elongated portion has each of a predetermined length and a predetermined shape. There is an arcuately shaped portion connected to the elongated portion of the bar member adjacent a first end thereof and at least one means disposed adjacent a second end of the elongated portion of the bar member for anchoring the apparatus to such overhead building structure and such building wall. There is also a means engageable with such at least one means for anchoring the apparatus to such overhead building structure and such building wall for enabling attachment of the apparatus to such overhead building structure and such building wall.

In a second embodiment of the invention there is provided an apparatus for supporting and holding a building panel during installation onto an overhead building structure. The apparatus comprises a bar member for supporting at least a portion of such building panel, the bar member having an elongated portion to be disposed substantially parallel to such overhead building structure when secured to at least one of such overhead building structure and a building wall in a working position, the elongated portion has each a predetermined length and a predetermined shape. There is an arcuately shaped portion connected to the elongated portion of the bar member adjacent a first end thereof and a first means telescopingly engageable with a second end of the elongated portion of the bar member for anchoring the apparatus to such overhead building structure and such building wall. There is further a second means engageable with the first means for enabling attachment of the apparatus to such overhead building structure and such building wall.

A third embodiment of the present invention provides an apparatus for supporting and holding a building panel during installation onto an overhead building structure. The apparatus comprises a bar member for supporting at least a portion of such building panel, the bar member has an elongated portion to be disposed substantially parallel to such overhead building structure when secured to at least one of such overhead building structure and a building wall in a working position. The elongated portion has each of a predetermined length and a predetermined shape. There is an arcuately shaped portion connected to the elongated portion of the bar member adjacent a first end thereof and an anchoring means disposed closely adjacent a second end of the elongated portion of the bar member for anchoring the apparatus to such overhead building structure and such building wall, the anchoring means has at least one first anchoring member hingedly engaged on a side of the bar member extending in an upwardly direction for anchoring the apparatus to such overhead building structure and has a second anchoring member disposed at the second end of the bar member transverse to the bar member and extending in a downwardly direction for anchoring the apparatus to such building wall. There is also a means engageable with the anchoring means for enabling attachment of the apparatus to such overhead building structure and such building wall.

In another embodiment of the present invention there is an apparatus for supporting and holding a building panel during installation onto an overhead building structure. The apparatus comprises a bar member for supporting at least a portion of such building panel, the bar member has an elongated portion to be disposed substantially parallel to such overhead building structure when secured to at least one of such overhead building structure and a building wall in a working position. Such elongated portion has each of a predetermined length and a predetermined shape. There is an arcuately shaped portion connected to the elongated portion of the bar member adjacent a first end thereof and an anchoring means disposed at a second end of the elongated portion of the bar member transverse to the bar member and extending in a downwardly direction for anchoring the apparatus to such building wall and a means engageable with the anchoring means for enabling attachment of such apparatus to such building wall.

In still another embodiment of the invention there is an apparatus for supporting and holding a building panel during installation onto an overhead building structure. The apparatus comprises a bar member for supporting at least a portion of such building panel. The bar member has an elongated portion to be disposed substantially parallel to such overhead building structure when secured to at least one of such overhead building structure and a building wall in a working position. The elongated portion has each of a predetermined length and a predetermined shape. There is an arcuately shaped portion connected to the elongated portion of the bar member adjacent a first end thereof and at least one anchoring means disposed closely adjacent a second end of the elongated portion of the bar member for anchoring the apparatus to such overhead building structure. The at least one anchoring means is formed as a projection extending in an upwardly direction from the bar member and there is a means engageable with such at least one anchoring means for enabling attachment of the apparatus to such overhead building structure.

OBJECTS OF THE INVENTION

It is, therefore, one of the primary objects of the present invention to provide an apparatus which would assist a single worker in making overhead installation of ceiling panels of drywall or plasterboard.

Another object of the present invention is to provide an apparatus which would be lightweight.

Still another object of the present invention is to provide an apparatus into which a sheet of ceiling panel could be easily mounted for support prior to attachment to ceiling joists.

It is yet another object of the present invention to provide an apparatus that is easily manufactured.

Another object of the present invention is to provide an apparatus that is inexpensive to manufacture.

In addition to the numerous objects and advantages of the present invention which have been described with some degree of particularity above, it should be both noted and understood that a number of other important objects and advantages of the apparatus for assisting in the installation of ceiling panels will become more readily apparent to those persons who are skilled in the relevant building art from the following more detailed description of the invention, particularly, when such detailed description is taken in conjunction with the appended claims.

Figure 1:
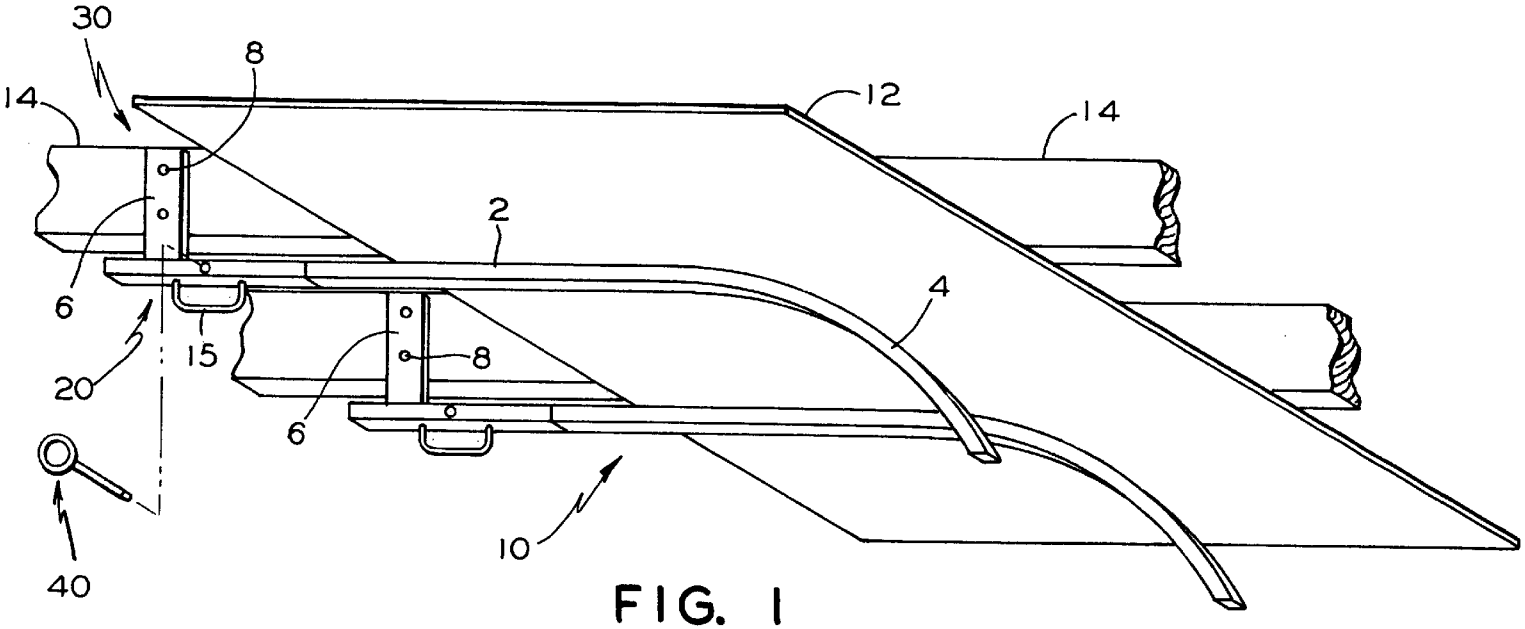
FIG. 1 is a partial perspective view of a pair of the apparatus secured to an overhead building structure with a ceiling panel in place in a first embodiment of the invention.

BRIEF DESCRIPTION OF THE PRESENTLY PREFERRED AND VARIOUS ALTERNATE EMBODIMENTS OF THE PRESENT INVENTION

Prior to proceeding to the more detailed description of the present invention, it should be noted that for the sake of clarity in understanding the invention, identical components with identical functions have been designated with identical reference numerals throughout the drawing Figures.

Figure 2:
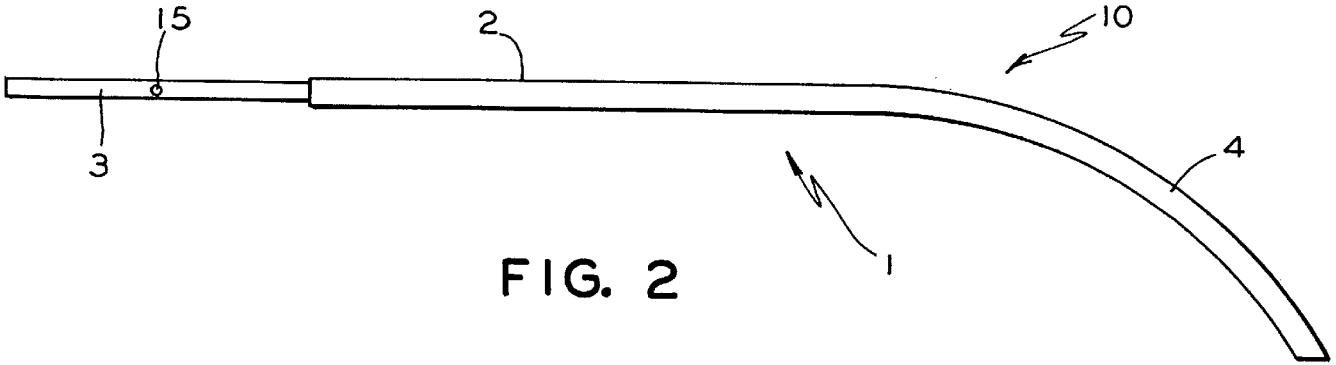
FIG. 2 is side elevation view of the bar member depicted in FIG. 1 in a first embodiment of the invention.

Reference is now made, more particularly, to FIG. 1 and FIG. 2. Illustrated therein is an apparatus, generally designated 10, for supporting and holding a building panel during installation onto an overhead building structure such as ceiling joists or roof trusses in a first and second embodiment of the invention. Such apparatus 10 comprises at least one bar member 1 for holding and supporting a building panel 12. Such building panel 12 can be a drywall panel, plasterboard or other types of building panels. In a presently preferred embodiment of the invention there are two bar member 1 used in overhead installations. A single bar can be used, however, it is preferred that two bars be used to support the building panel 12.

Such bar member(s) 1 has an elongated portion 2 that is disposed substantially parallel to such overhead building structure 14 when it is secured in a working position to at least one of an overhead building structure 14 and a building wall (not shown). Such building structure 14 is generally a ceiling joist and a building wall is generally wall studs. Also it must be mentioned that overhead building structures can also include such sloped ceilings as might be found in some attics or dormers.

The elongated portion 2 has a predetermined length and a predetermined shape. Such bar member 1 further has an arcuately shaped portion 4 adjacent a first end of the elongated portion 2. Two bars 1 support a building panel 12 easily, as is evident in FIG. 1, so that a single worker can attach a 4 ft. by 8 ft. building panel 12 to such ceiling joists 14.

It is also presently preferred that such predetermined length of such elongated portion 2 of such bar 1 be at least more than half the width of a building panel 12. Since most building panels 12 have a width of 4 feet and a length of 8 feet, it is preferred that such predetermined length of such elongated portion 2 of bar member 1 be at least 2 feet long. The predetermined shape of such bar member 1 may be round, rectangular which includes square, hexagonal and octagonal. It is presently preferred that the predetermined shape of such bar member 1 be substantially rectangular and more specifically that it be substantially square.

There is also at least one anchoring means, generally designated 20, that is disposed closely adjacent a second end of the elongated portion 2 of the bar member 1 for anchoring the apparatus 10 to such overhead building structure 14 or to a building wall. Further, there is a means, generally designated 30, that is engageable with the anchoring means 20, for enabling attachment of the at least one anchoring means 20 to such building structure 14 or to a building wall.

Figure 3:
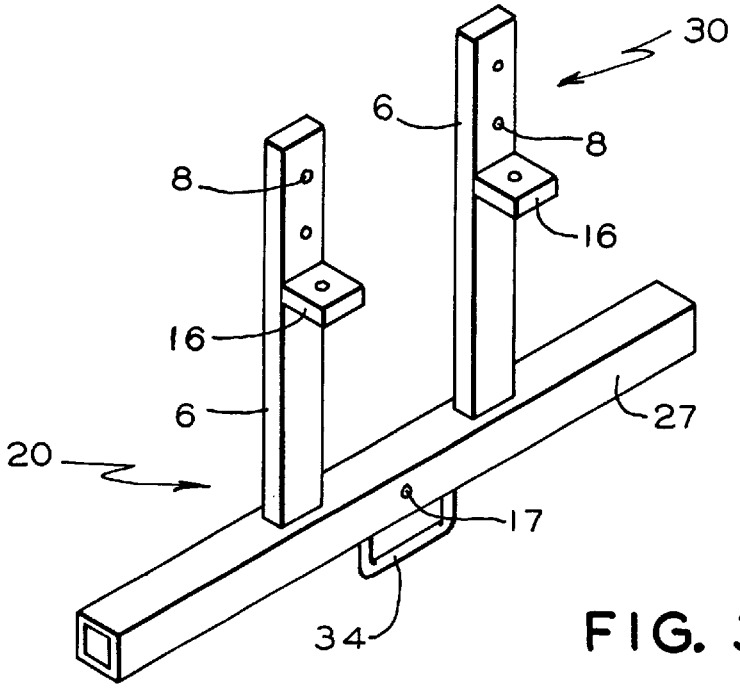
FIG. 3 is a partial perspective view of a means for anchoring the apparatus shown in FIG. 1 to a building ceiling joist in a first embodiment of the invention.
Figure 4:
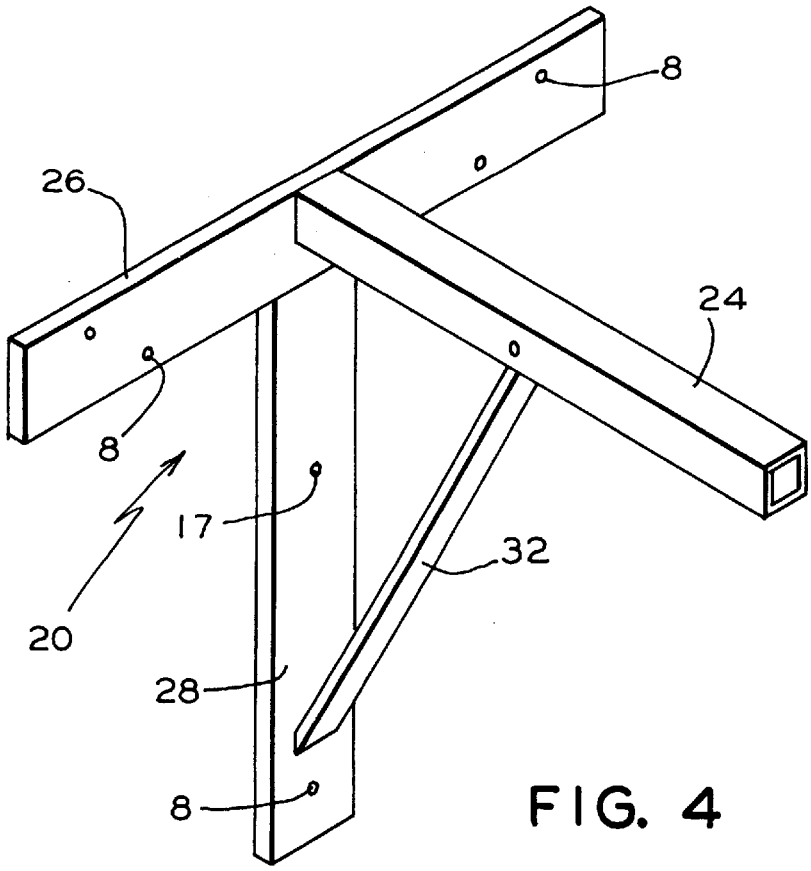
FIG. 4 is a partial perspective view of a means for anchoring the apparatus shown in FIG. 1 to a building wall member in a first embodiment of the invention.

Reference is now made, more specifically, to FIG. 3 and FIG. 4. Illustrated therein are examples of such anchoring means 20 for use in attaching the apparatus 10 to an overhead building structure 14 or to a building wall. Such anchoring means 20, in one embodiment, includes a first member 22 that is telescopingly engageable with a second end 3 of such elongated portion 2 of bar member 1. Anchoring means 20 further includes at least one projection 6 that is formed on such first member 22 closely adjacent an end of such first member 22 and extending in an upwardly direction. It is presently preferred that there are two projections 6 formed on such first member 22. Each of the projections 6 are closely adjacent an end of such first member 22 and extend in an upwardly direction. Such anchoring means 20 with such first member 22 can be telescopingly engaged with such second end 3 of elongated portion 2 from either end of first member 22.

Such anchoring means 20 further includes a second portion 16 that is disposed intermediate a first end and a second end of such projection 6. Such second portion 16 is substantially transverse to projection 6. Thus, when such anchoring means 20 attaches to an overhead building member such projection 6 fits securely against the side of a ceiling joist 14 while the second portion 16 is secured against the bottom of the ceiling joist 14. This can be seen clearly in FIG. 6.

Figure 6:
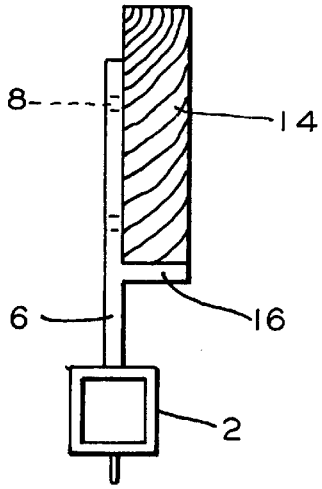
FIG. 6 is an end view of the apparatus showing another embodiment of the invention.

Also it is evident in FIG. 6 that such projection 6 and the attachment 16 form a right angle that fits snugly against a ceiling joist 14. In this manner such bar member 1 is secured tightly to the building structure 14.

Thus, the presently preferred embodiment of the invention includes two bars 1, with two projections 6 formed on each of the bars 1. Each projection 6 also has a second portion 16 disposed on the projection 6 in the presently preferred embodiment. It is also presently preferred that there be apertures 8 formed in the projection 6 as part of such means 30 for attachment to the ceiling joists 14. Second portions 16 disposed on each of such projections 6 are disposed in horizontal alignment with each other so that such portions 16 fit securely against such ceiling joist 14.

One additional point with regard to the second portion 16. It is presently preferred that the distance between such second portion 16 and the top of first member 22 be substantially one inch. This distance is sufficient to provide enough room to permit virtually all of the commonly used building panels of plasterboard or drywall to slide easily on the top of such bar member 1 between such elongated portion 2 and the bottom of such ceiling joists 14 without allowing the panels too much room so they could flop around.

Again, in the presently preferred embodiment of the invention such anchoring means 20 for securing to such overhead building structures has two projections 6 extending upwardly from first member 22 and each of the projections 6 have a second portion 16 disposed intermediate a first end and a second end of such projection 6 with second portion 16 being substantially transverse to projection 6. Such second portions 16 being substantially transverse to projections 6 are in horizontal alignment.

There is further a means 30 for enabling attachment of such anchoring means 20 to such building structure 14. Means 30 includes at least one aperture 8 in such projection 6 and in second portion 16. Such means 20 may further include screws or nails. It is presently preferred that screws are used together with such aperture 8 as part of means 30 for attaching such projection 6 to the ceiling joists 14. In this manner the screws can be the same ones that are used to attach the ceiling panel 12 to the ceiling joist 14 so that a worker need not carry different items in his tool belt. It is also an embodiment of the invention that such means 30 for attaching the anchoring means 20 to the ceiling joists can be a C-clamp.

In the presently preferred embodiment of the invention there are two projections 6 on each bar 1 and it is, further, also presently preferred that there be two apertures 8 on each projection 6. It is also preferred that there is an aperture on each of second portion 16.

The first member 22 further includes a handle like member 34 disposed on the bottom side of first member 22 opposite the top side of first member 22 to which the projection 6 is attached. Such handle member 34 is a convenient place to hook on a cordless powered drill/screwdriver so that the worker need not hold it while he is putting a building panel in place for installation.

As is evident in FIG. 2, a reinforced portion 5 of the elongated portion 2 is thicker, so as to provide for added support, than is the rest of the elongated portion 2 and arcuate portion 4 of the bar member 1. However it is important to note that the reinforced portion 5 does not extend over the top of the bar member 1 so that the top of the bar member 1 is smooth and there are no ridges for the building panels to catch on. It is preferred that the bar be reinforced as described; however, the apparatus would still be effective without the reinforcement.

In an alternate embodiment of the invention, illustrated in FIG. 4, anchoring means 20 is used in attaching the apparatus 10 to a building wall. Anchoring means 20 includes a second member 24. Second member 24 is virtually identical to first member 22 that was described previously. Second member 24 is telescopingly engageable with such second end 3 of such elongated portion 2 of bar member 1. Second member 24, in one embodiment, includes a second portion 26 which is attached to an end of first member 24 and is transverse to first member 24. It further includes a third portion 28 attached to such second portion 26 extending in a downwardly direction. In this embodiment such second portion 26 and third portion 28 have a shape like a capital letter T. In this embodiment such anchoring means 20, further, has a support member 32 which connects at an angle between such first member 24 and such third member 28 providing support for first member 22.

Figure 8A:
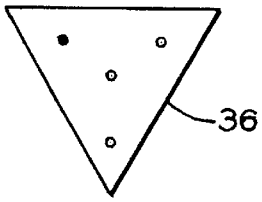
FIGS. 8*a* and 8*b* are front views of different embodiments of the end piece of the apparatus shown in FIGS. 4 and 7 that is used to attach to a wall member.
Figure 8B:
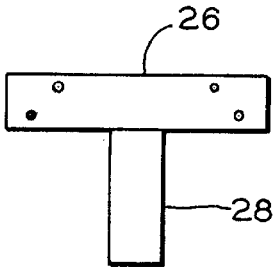

In an alternate embodiment an end of such second member 24 is connected to a triangular member 36 seen in FIG. 8*a* rather than the T shape seen in FIG. 8*b* and FIG. 4. Both of these end pieces are used in conjunction with second member 24 to mount to a building wall so as to provide support for the bar when installing the first panel on the part of the ceiling that would be adjacent to the building wall. After the first panel is installed the other embodiment that attaches to the ceiling joists, described previously, is used to attach the remaining building panels to the ceiling. In the presently preferred embodiment of the invention such portion in the shape of the capital letter T is used.

In one embodiment of the invention such first member 22, with all its attachments, and such second member 24, with its attachments, are interchangeable. Such bar member 1 has a first aperture 15 that is disposed closely adjacent the second end of such elongated portion 2. Further, there is a second aperture 17 disposed substantially at a midpoint of such first member 22 and such second member 24. Such apertures 15 and 17 are in alignment when such first member 22 or second member 24 are telescopingly engaged with the second end of elongated portion 2. Anchoring means 20 and such bar member 1 are further secured by using one of a pin, bolt, dowel, or rivet to pass through the aligned apertures. It is presently preferred that a pin, generally designated 40, be disposed in the apertures to secure the anchoring means 20 to the elongated portion 2 of bar member 1. Further, it is preferred that such pin 40 have an O-ring attached to the end of such pin 40 for ease in removing and inserting the pin 40.

Figure 5:
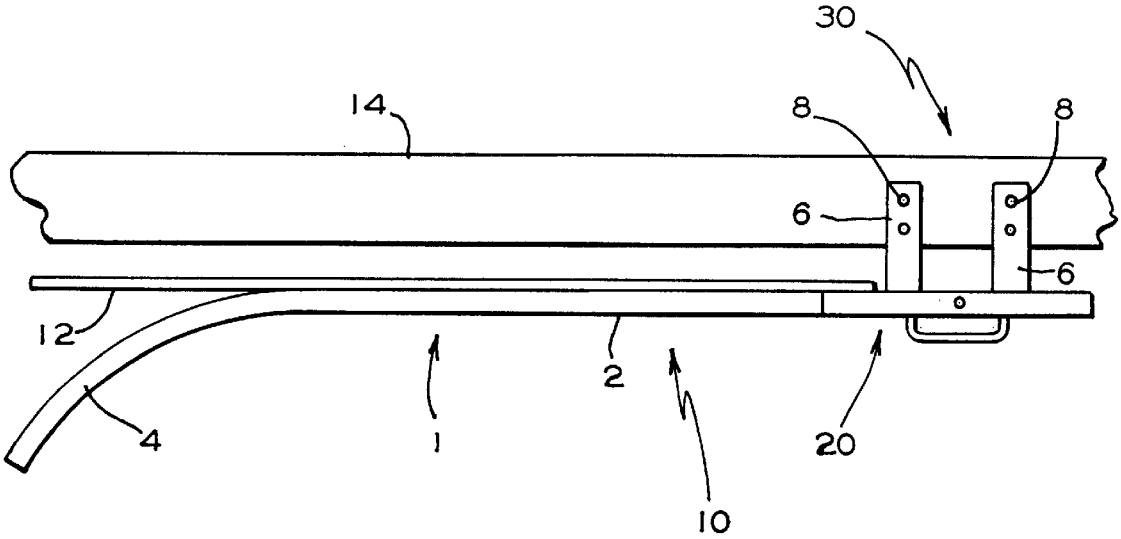
FIG. 5 is a side-elevational view of the apparatus in an alternate embodiment of the invention in which the apparatus is attached to ceiling joist with a ceiling panel in place.

FIG. 5 shows a side view of the apparatus 10 as it is in place with a building panel 12 in place and the anchoring means 20 attached to a ceiling joist 14.

Figure 7:
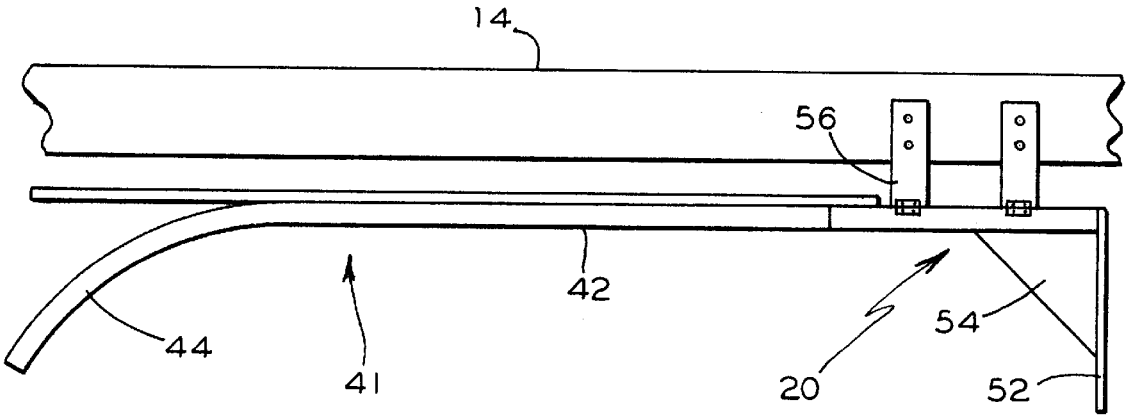
FIG. 7 is a side-elevational view of the apparatus in an embodiment of the invention in which the apparatus can be attached either to an overhead building member or to a wall member.

FIG. 7 is a similar view but it shows another embodiment of the invention. In this embodiment the apparatus 10 is single unit with the anchoring means 20 including a first anchoring member 56. First anchoring member 2 is a projection that is hingedly engaged on a side of bar member 41. It is important that such first anchoring member be attached to the side rather the top portion of the elongated portion 42 of bar member 41 so that the hinged portion may drop down and be out of the way when then apparatus is to be used in an attachment to a building wall. The anchoring means 20 further includes a second anchoring member 52 that is disposed at the second end of the elongated portion 42 of bar member 41. Such second anchoring member 52 is transverse to bar member 41 and extends in a downwardly direction for anchoring such apparatus 10 to a building wall.

As with the other embodiments the second anchoring member 52 could have either of the shapes that would be similar to a capital letter T or a triangle as are shown in FIGS. 8*a* and 8*b*. This embodiment could be used for any overhead installation whether it is the first panel where the apparatus 10 is attached to a wall member with the hinged first anchoring member 56 unlocked and hinged downward so as to be out of the way or for any other overhead installation where first anchoring member 52 is lockedly hinged in an upward position for attachment to a ceiling joist 14. It must be noted that in this embodiment such second anchoring member 52 must be disposed at the end of the elongated portion 42 so that the top portion of second anchoring member 52 not be any higher than the top of elongated portion 42 so that the second anchoring member 52 will not interfere with the operation when the apparatus 10 is attached to a ceiling joist 14.

For any of the embodiments, such bar member 1 or 41 and projection 6 or 56 may be constructed of aluminum, lightweight steel or plastic. It is presently preferred that bar member 1 be made of lightweight steel. Thus, the bar member 1 is very light weight, is easily transported, uses very little storage space and is very easy to use. Further, it is easy to manufacture and should be relatively inexpensive to purchase. As mentioned previously, in the presently preferred embodiment of the invention a pair of bar members 1 are used in the installation of such building panels 12. However, it is well within the scope of the invention that a single bar member 1 could be used alone or that three bars could be used so as to give added support.

The design of the bar member 1, with the elongated portion 2 disposed substantially parallel to such ceiling joist 14 when it is secured in a working position and with such arcuately shaped portion 4 adjacent a first end of the elongated portion 2, makes such apparatus 10 easy to use. The arcuate portion 4 on the open end of the bar member 1 enables one worker to easily slide the building panel 12 (a sheet of drywall or plasterboard) onto the bars for holding and supporting the panel, such building panel can then be easily attached into the ceiling joist with the use of screws and probably a cordless power drill/screwdriver. After installation of one panel the apparatus 10 is removed and moved to the next position and another panel installed. The bar members 1 hold all the weight of the panel and helps minimize worker fatigue. Thus, with the use of the present invention, one worker can easily install a 4 foot by 8 foot panel on the ceiling without the need of outside assistance. In some ways the apparatus works better than having a second worker help because it holds the panels so easily that it virtually eliminates any problem with breaking of a panel while it is being installed since there is little chance of the panel being twisted or bent.

While a presently preferred embodiment and alternate embodiments of the present invention has been described in detail above, it should be understood that various other adaptations and/or modifications of the invention can be made by those persons who are particularly skilled in the building art without departing from either the spirit of the invention or the scope of the appended claims.

I claim:

1. An apparatus for supporting and holding a building panel during installation onto an overhead building structure, said apparatus comprising;

(a) a bar member for supporting at least a portion of such building panel, said bar member having an elongated portion to be disposed substantially parallel to such overhead building structure when secured in a working position to at least one of such overhead building structure and a building wall, said elongated portion having each of a predetermined length and a predetermined shape;

(b) an arcuately shaped portion connected to said elongated portion of said bar member adjacent a first end thereof;

(c) at least one means disposed adjacent a second end of said elongated portion of said bar member for anchoring said apparatus to at least one of such overhead building structure and such building wall; and (d) a means engageable with said at least one means for anchoring said apparatus to such overhead building structure and such building wall for enabling attachment of said apparatus to at least one of such overhead building structure and such building wall.

2. An apparatus for supporting and holding a building panel, according to claim 1, wherein a pair of said apparatus are used during installation of such building panel.

3. An apparatus for supporting and holding a building panel, according to claim 1, wherein said at least one means for anchoring includes a first member telescopingly engageable with a second end of said elongated portion of said bar member.

4. An apparatus for supporting and holding a building panel, according to claim 3, wherein said first member telescopingly engageable with a second end of said elongated portion of said bar member is one of mountable to such building wall and mountable to such overhead building structure.

5. An apparatus for supporting and holding a building panel, according to claim 4, wherein said first member mountable to such building wall and said first member mountable to such overhead building structure are interchangeable.

6. An apparatus for supporting and holding a building panel, according to claim 4, wherein said first member of said at least one anchoring means is mountable to an overhead building member and includes at least one projection formed on said first member closely adjacent an end of said first member and extending in an upwardly direction.

7. An apparatus for supporting and holding a building panel, according to claim 6, wherein said at least one means for anchoring to such overhead building member further includes a handle like portion disposed on a side of said first member opposite a side to which said at least one projection is formed.

8. An apparatus for supporting and holding a building panel, according to claim 6, wherein said at least one projection formed on said first member mountable to an overhead building member further includes a second portion disposed intermediate a first end and a second end of said projection, said second portion being substantially transverse to said at least one projection.

9. An apparatus for supporting and holding a building panel, according to claim 8, wherein said apparatus includes a pair of projections.

10. An apparatus for supporting and holding a building panel, according to claim 9, wherein each of said pair of projections includes a second portion disposed intermediate a first end and a second end of said at least one projection, said second portion being substantially transverse to said at least one projection.

11. An apparatus for supporting and holding a building panel, according to claim 10, wherein said second portion of each of said pair of projections are in horizontal alignment.

12. An apparatus for supporting and holding a building panel, according to claim 6, wherein said means for enabling attachment includes at least one aperture formed through said at least one projection.

13. An apparatus for supporting and holding a building panel, according to claim 12, wherein said means for enabling attachment further includes at least one of screws and nails.

14. An apparatus for supporting and holding a building panel, according to claim 4, wherein said first member is mountable to such building wall and includes a second portion disposed at said second end of said first member transverse to said bar member and extending in a downwardly direction for anchoring said apparatus to such building wall.

15. An apparatus for supporting and holding a building panel, according to claim 14, wherein said second portion disposed at an end of said first member transverse to said bar member and extending in a downwardly direction for anchoring said apparatus to such building wall has one of a shape like a triangle and a T.

16. An apparatus for supporting and holding a building panel, according to claim 1, wherein said bar member is selected from aluminum, lightweight steel, and plastic.

17. An apparatus for supporting and holding a building panel, according to claim 16, wherein said bar member is lightweight steel.

18. An apparatus for supporting and holding a building panel, according to claim 1, wherein said means for enabling attachment includes a C-clamp.

19. An apparatus for supporting and holding a building panel, according to claim 1, wherein said predetermined length of said elongated portion of said bar member is greater than two feet.

20. An apparatus for supporting and holding a building panel, according to claim 1, wherein said predetermined shape of said bar member is rectangular.

21. An apparatus for supporting and holding a building panel during installation onto an overhead building structure, said apparatus comprising;

(a) a bar member for supporting at least a portion of such building panel, said bar member having an elongated portion to be disposed substantially parallel to such overhead building structure when secured to at least one of such overhead building structure and a building wall in a working position, said elongated-portion having each of a predetermined length and a predetermined shape;

(b) an arcuately shaped portion connected to said elongated portion of said bar member adjacent a first end thereof;

(c) a first means telescopingly engageable with a second end of said elongated portion of said bar member for anchoring said apparatus to at least one of such overhead building structure and such building wall; and (d) a second means engageable with said first means for enabling attachment of said apparatus to such overhead building structure and such building wall.

22. An apparatus for supporting and holding a building panel, according to claim 21, wherein said first means includes one of at least one second member formed on a side of said first means closely adjacent an end of said first means as a projection and extending in an upwardly direction for anchoring said apparatus to such overhead building structure, and a second member disposed at an end of said first means transverse to said bar member and extending in a downwardly direction for anchoring said apparatus to such building wall.

23. An apparatus for supporting and holding a building panel, according to claim 21, wherein said elongated portion of said bar member further includes a first aperture closely adjacent said second end and said first means further includes a second aperture substantially at a midpoint of said first means, said first aperture and said second aperture being substantially in alignment when said first means is telescopingly engaged with said second end of said elongated portion of said bar member.

24. An apparatus for supporting and holding a building panel, according to claim 23, wherein said first means and said elongated portion of said bar member are further secured by means of one of a pin, bolt, dowel, and rivet which is disposed in said first aperture and said second aperture.

25. An apparatus for supporting and holding a building panel during installation onto an overhead building structure, said apparatus comprising;

(a) a bar member for supporting at least a portion of such building panel, said bar member having an elongated portion to be disposed substantially parallel to such overhead building structure when secured to at least one of such overhead building structure and a building wall in a working position, said elongated portion having each of a predetermined length and a predetermined shape;

(b) an arcuately shaped portion connected to said elongated portion of said bar member adjacent a first end thereof;

(c) an anchoring means disposed closely adjacent a second end of said elongated portion of said bar member for anchoring said apparatus to such overhead building structure and such building wall, said anchoring means having at least one first anchoring member hingedly engaged on a side of said bar member extending in an upwardly direction for anchoring said apparatus to such overhead building structure and having a second anchoring member disposed at said second end of said bar member transverse to said bar member and extending in a downwardly direction for anchoring said apparatus to such building wall; and (d) a means engageable with said anchoring means for enabling attachment of said apparatus to such overhead building structure and such building wall.

26. An apparatus for supporting and holding a building panel during installation onto an overhead building structure, said apparatus comprising;

(a) a bar member for supporting at least a portion of such building panel, said bar member having an elongated portion to be disposed substantially parallel to such overhead building structure when secured to at least one of such overhead building structure and a building wall in a working position, said elongated portion having each of a predetermined length and a predetermined shape;

(b) an arcuately shaped portion connected to said elongated portion of said bar member adjacent a first end thereof;

(c) an anchoring means disposed at a second end of said elongated portion of said bar member transverse to said bar member and extending in a downwardly direction for anchoring said apparatus to such building wall; and (d) a means engageable with said anchoring means for anchoring said apparatus to such building wall for enabling attachment of said apparatus to such building wall.

27. An apparatus for supporting and holding a building panel during installation onto an overhead building structure, said apparatus comprising;

(a) a bar member for supporting at least a portion of such building panel, said bar member having an elongated portion to be disposed substantially parallel to such overhead building structure when secured to at least one of such overhead building structure and a building wall in a working position, said elongated portion having each of a predetermined length and a predetermined shape;

(b) an arcuately shaped portion connected to said elongated portion of said bar member adjacent a first end thereof;

(c) at least one anchoring means disposed closely adjacent a second end of said elongated portion of said bar member for anchoring said apparatus to such overhead building structure, said at least one anchoring means formed as a projection extending in an upwardly direction from said bar member; and (d) a means engageable with said at least one anchoring means for anchoring said apparatus to such overhead building structure for enabling attachment of said apparatus to such overhead building structure.

* * * * *